US007320399B2

(12) United States Patent
Ghini et al.

(10) Patent No.: US 7,320,399 B2
(45) Date of Patent: Jan. 22, 2008

(54) LATERAL-OPENING RIGID HINGED-LID PACKET

(75) Inventors: Marco Ghini, S. Lazzaro Di Savena (IT); Fiorenzo Draghetti, Medicina (IT)

(73) Assignee: G.D Societa' per Azioni, Bologna (IT)

( * ) Notice: Subject to any disclaimer, the term of this patent is extended or adjusted under 35 U.S.C. 154(b) by 453 days.

(21) Appl. No.: 10/484,125

(22) PCT Filed: Jul. 17, 2002

(86) PCT No.: PCT/IT02/00471

§ 371 (c)(1),
(2), (4) Date: Jul. 22, 2004

(87) PCT Pub. No.: WO03/008302

PCT Pub. Date: Jan. 30, 2003

(65) Prior Publication Data

US 2005/0016876 A1 Jan. 27, 2005

(30) Foreign Application Priority Data

Jul. 17, 2001 (IT) ..... BO2001A0451

(51) Int. Cl.
*B65D 85/10* (2006.01)

(52) U.S. Cl. ..... 206/268; 206/271

(58) Field of Classification Search ..... 206/249, 206/254, 268, 271, 273, 261; 229/122, 160.1
See application file for complete search history.

(56) References Cited

U.S. PATENT DOCUMENTS

| | | | | |
|---|---|---|---|---|
| 4,753,384 | A * | 6/1988 | Focke et al. | 229/160.1 |
| 4,949,841 | A | 8/1990 | Focke et al. | |
| 5,435,440 | A * | 7/1995 | Focke et al. | 206/271 |
| 5,957,280 | A * | 9/1999 | Focke et al. | 206/264 |
| 6,164,444 | A | 12/2000 | Bray et al. | |
| 6,715,605 | B1 * | 4/2004 | Manservigi et al. | 206/268 |
| 2002/0190110 | A1 * | 12/2002 | Polloni et al. | 229/110 |

FOREIGN PATENT DOCUMENTS

WO WO 01/15999 A1 8/2001

* cited by examiner

*Primary Examiner*—David T. Fidei
(74) *Attorney, Agent, or Firm*—Marshall, Gerstein & Borun LLP

(57) ABSTRACT

A rigid cigarette packet having a case (1) defined by a cup-shaped container (12) closed by a hinged, lateral-opening lid (11), and wherein the lid (11) incorporates at least part of a top wall (4) of the case (1); and the case (1) is formed from a blank (44) having two panels (4', 4") which are superimposed to form the top wall (4) of the case (1), and houses a tubular collar (18) closed at the top by a wall (20; 67; 74) adjacent to the top wall (4) of the case (1) and including a removable panel (27; 71; 80) located at the lid (18).

44 Claims, 9 Drawing Sheets

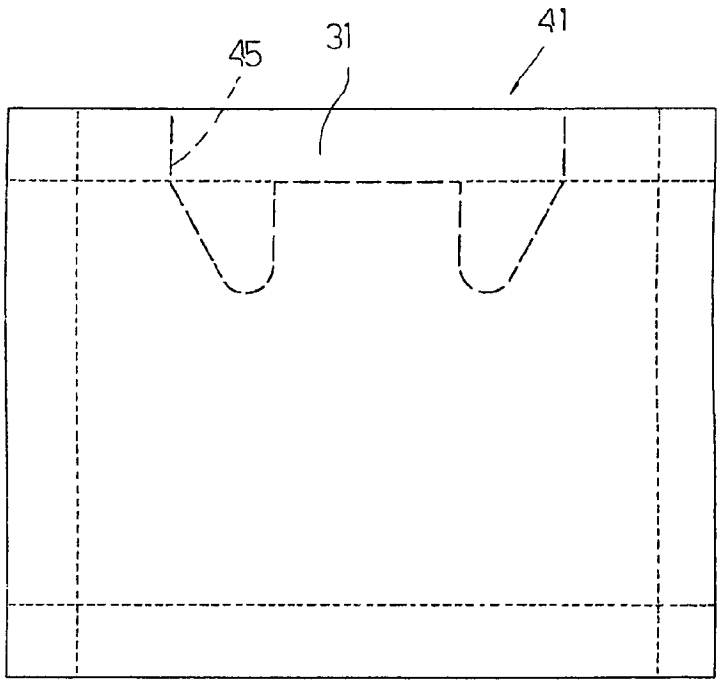
Fig.9
Fig.10
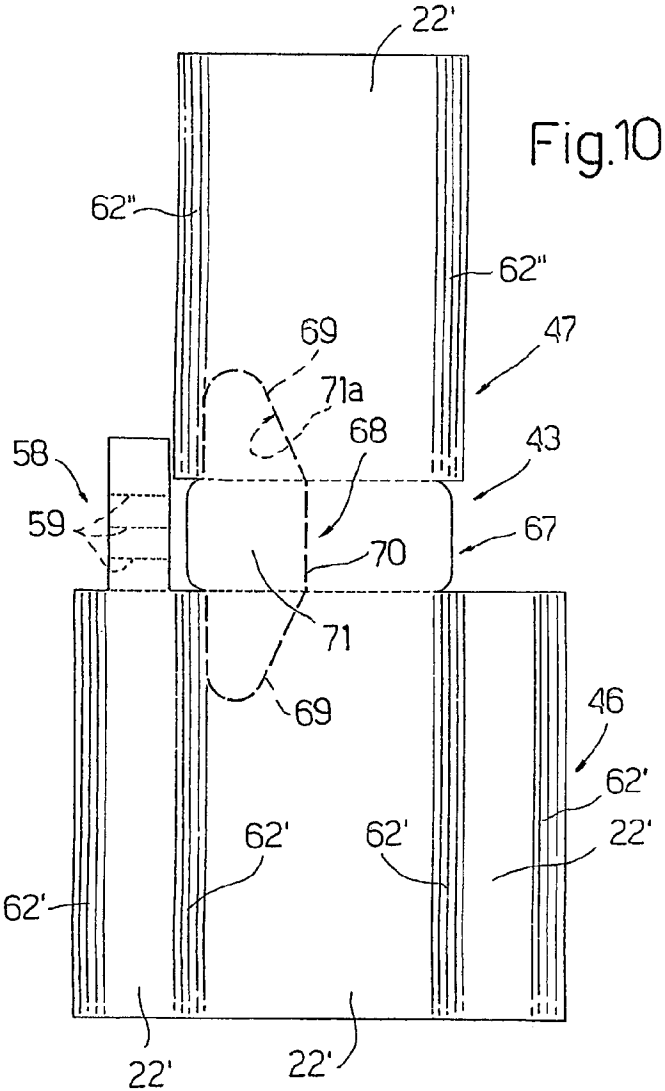

LATERAL-OPENING RIGID HINGED-LID PACKET

CROSS-REFERENCE TO RELATED APPLICATION

This application is the U.S. National Stage application of PCT/IT02/00471 filed Jul. 17, 2002.

TECHNICAL FIELD

The present invention relates to a lateral-opening, rigid, hinged-lid packet.

More specifically, the present invention relates to a lateral-opening, rigid, hinged-lid packet of the type comprising a case having a top wall and in turn comprising a cup-shaped container with a top opening, a collar projecting partly from said cup-shaped container through said top opening, and a lid hinged to said cup-shaped container along a lateral hinge and movable about said hinge to and from a closed position closing said top opening; said lid incorporating at least part of said top wall.

The present invention may be used to advantage in the tobacco industry in the field of cigarette packets to which the following description refers purely by way of example.

BACKGROUND ART

Packets of the aforementioned type are, for example disclosed in WO 01/1599. In particular, WO 01/1599 discloses a lateral-opening, rigid, hinged-lid cigarette packet comprising a case having two minor lateral walls and two major lateral walls, which are wider than the two minor lateral walls, and a top wall. The case in turn comprises a cup-shaped container with a top opening, a collar projecting partly from said cup-shaped container through said top opening, and a lid, which incorporates at least part of the top wall and is hinged to said cup-shaped container along a lateral hinge and movable about said hinge to and from a closed position closing said top opening. The lateral hinge is located on the top wall and is perpendicular to the major lateral walls.

In known lateral-opening, rigid, hinged-lid packets of the above type, the hinge connecting the lid to the cup-shaped container is normally fairly short. This is inevitable in lateral-opening packets, and seriously impairs the shape stability of the packet, which, with use, tends to deform, so that the lid fails to close the cup-shaped container properly.

DISCLOSURE OF THE INVENTION

It is an object of the present invention to provide a lateral-opening, rigid, hinged-lid packet designed to eliminate the aforementioned drawback.

According to the present invention, there is provided a lateral-opening, rigid, hinged-lid packet.

BRIEF DESCRIPTION OF DRAWINGS

A number of non-limiting embodiments of the present invention will be described by way of example with reference to the accompanying drawings, in which:

FIGS. 9, 10 and 11 show plan views of respective elements of the FIG. 8 packet;

BEST MODE FOR CARRYING OUT THE INVENTION

Figure 1:
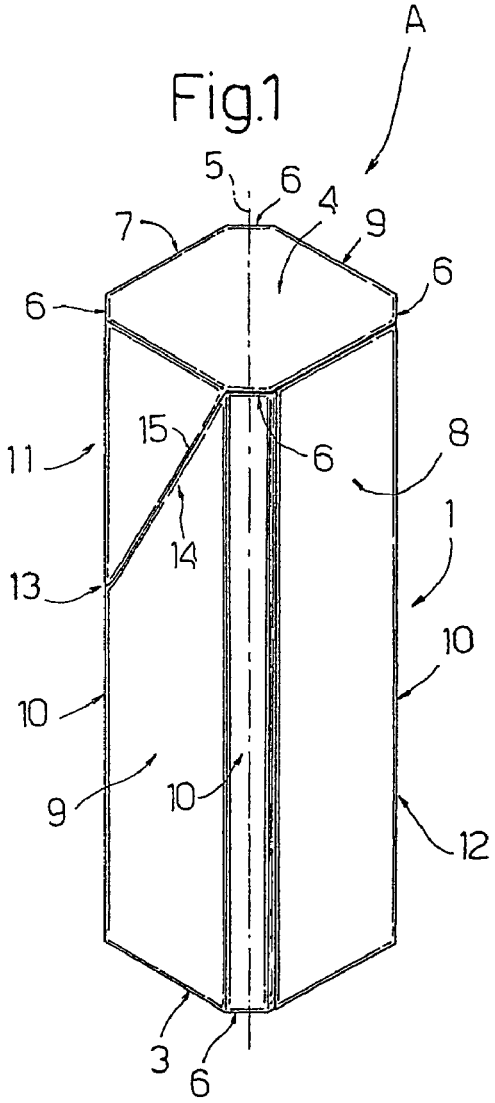
FIG. 1 shows a view in perspective of a first preferred embodiment of the packet according to the present invention in the closed position.
Figure 2:
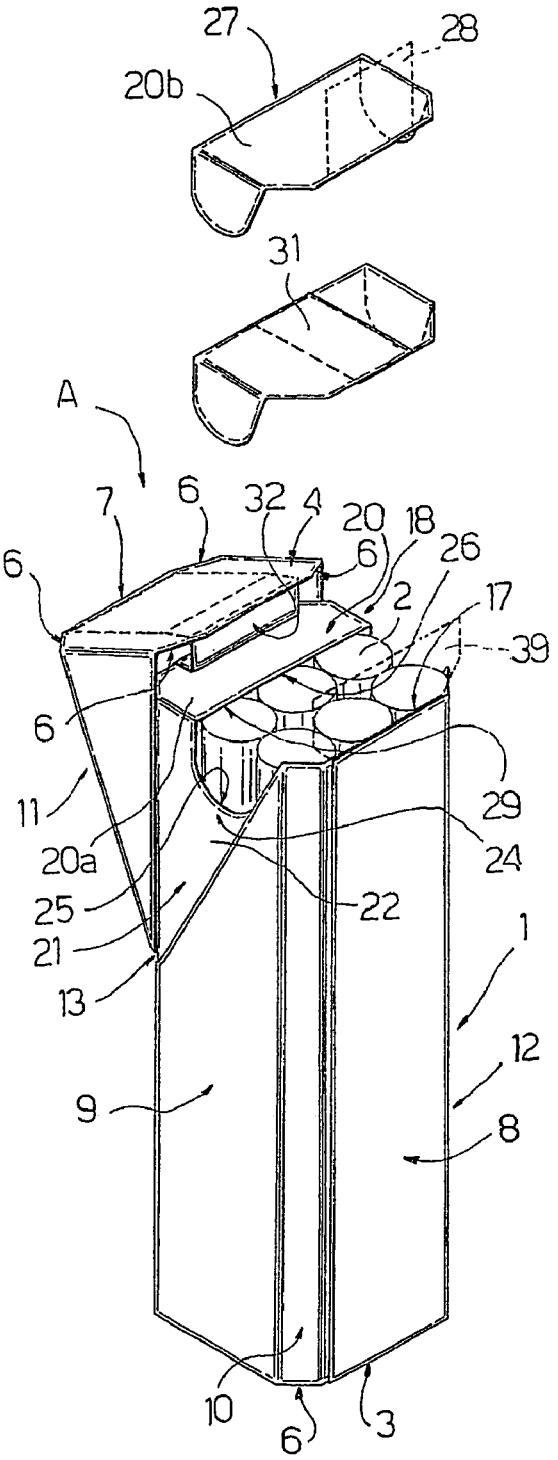
FIG. 2 shows an exploded view in perspective of the FIG. 1 packet in the open position.
Figure 3:
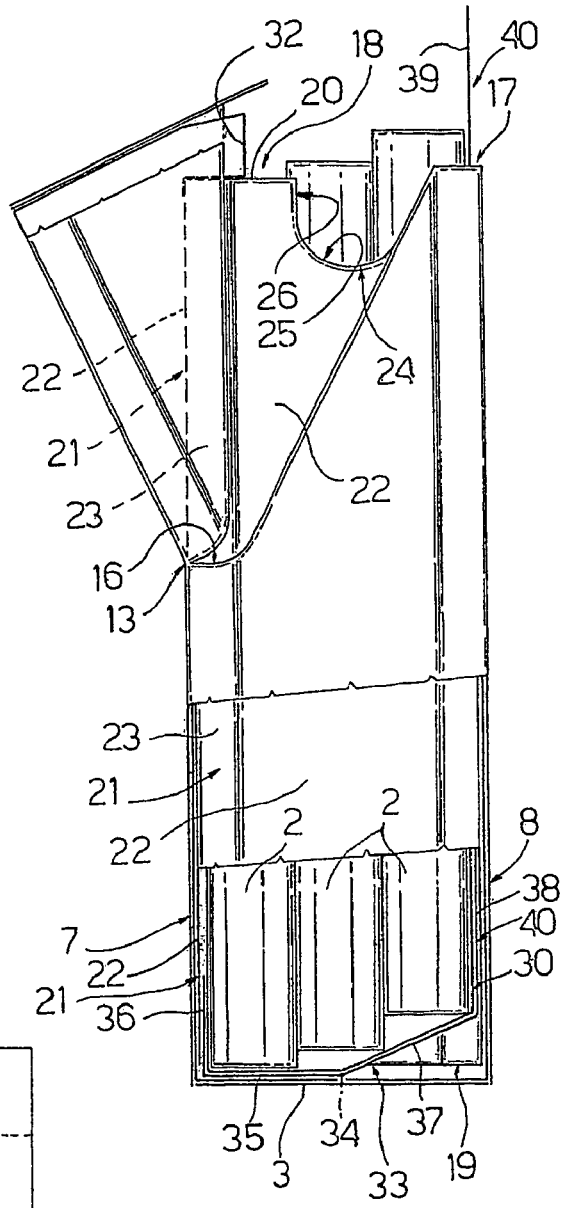
FIG. 3 shows a partly sectioned side view of the FIG. 2 packet.

With reference to FIGS. 1 to 3, the letter A indicates as a whole a rigid, hinged-lid packet for a number of cigarettes 2.

Packet A comprises a prismatic outer case 1 defined by a bottom wall 3 and a top wall 4, which are identical and parallel, are perpendicular to a longitudinal axis 5 of case 1, and are substantially square with a 45° bevel 6 at each corner. Case 1 is defined laterally by a pair of parallel lateral walls 7 and 8; a further pair of parallel, specularly identical lateral walls 9 perpendicular to lateral walls 7 and 8; and four longitudinal strips 10, each of which extends between corresponding bevels 6 of top and bottom walls 4 and 3, and connects a respective lateral wall 9 to a lateral wall 7 or 8.

It is important to point out that the substantially squared-shape of the bottom and top walls 3 and 4 improves the shape stability of the packet.

A lateral-opening lid 11 is formed on case 1, is defined at the top by the whole of top wall 4, is hinged to the rest of case 1—defined by a cup-shaped container 12—by a hinge 13 extending across an intermediate portion of wall 7 and crosswise to longitudinal axis 5, and is separated from the rest of case 1 by a tear line 14 (along which packet A is torn open by the user) having: a first portion extending along the join between top wall 4 and lateral wall 8 and the two longitudinal strips 10 adjacent to lateral wall 8; a second portion defined by two inclined slits 15, each of which is formed across a respective lateral wall 9, and extends across the whole width of lateral wall 9, from a corner of lateral wall 9 adjacent to top wall 4 and wall 8, to an intermediate point along the edge of lateral wall 9 adjacent to lateral wall 7 and on a level with hinge 13; and a third portion defined by two slits 16, each of which is formed across a respective longitudinal strip 10 adjacent to lateral wall 7, to connect the bottom end of relative slit 15 to a relative end of hinge 13.

Tear line 14 defines the edge of a top opening 17 of cup-shaped container 12, from which projects outwards the top end of a cup-shaped collar 18 located inside cup-shaped container 12 with its concavity facing bottom wall 3, with a free annular edge 19 substantially contacting the inner surface of bottom wall 3, and with an end wall 20 just inwards of top wall 4. End wall 20 is also substantially square with 45° beveled corners, and closes a tubular body 21 defined by four lateral walls 22 connected to one another by longitudinal strips 23 at the bevels of end wall 20.

It is important to point out that the tubular body 21 and the end wall 20 improve the shape stability of the packet allowing the lid 11 to better close the cup-shaped container 12.

As shown in FIG. 2, a tear line 24 is formed across the end of cup-shaped collar 18 facing opening 17, and has two portions defined by two U-shaped slits 25, each located with its concavity facing upwards on the projecting portion of a respective lateral wall 22 contacting the inner surface of a respective lateral wall 9 as of the top end of lateral wall 22. Tear line 24 also comprises a straight slit 26 formed across end wall 20, joining the two end points of the two slits 25 closest to lateral wall 7, and dividing end wall 20 into two portions 20*a* and 20*b*, of which portion 20*a* extends between straight slit 26 and lateral wall 7.

As shown in FIG. 2, tear line 24 defines a panel 27, which can be removed by the user, when opening packet A, using a tab 28 folded on to the outer surface of portion 20*b* and integral with an edge of portion 20*b* extending in contact with the inner surface of wall 8. When removed, panel 27 defines, across cup-shaped collar 18, a passage or opening 29 revealing an inner foil wrapping 30 also having a removable panel 31.

As shown more clearly in FIG. 3, the edge of end wall 20 facing wall 7 is connected to a central portion of the inner surface of top wall 4 by a toggle strap 32 for limiting within a given angle and restraining the travel of lid 11 about hinge 13 and with respect to cup-shaped container 12.

As shown more clearly in FIG. 3, a panel 33, of the same shape as bottom wall 3, rests on the inner surface of bottom wall 3, and is divided into two by a hinge 34 defining on panel 33: a first portion 35 adjacent to lateral wall 7, integral with bottom wall 3, and having an appendix 36 integral with lateral wall 7; and a second portion 37 adjacent to lateral wall 8 and connected integrally, at an edge substantially contacting the inner surface of wall 8, to the bottom end of a strap 38, which extends along tubular body 21 and terminates with a pull tab 39 folded squarely on to the top surface of inner wrapping 30 at opening 29. Panel 33, tab 39 and strap 38 define an extracting device 40 for extracting cigarettes 2 through opening 29.

According to an alternative and not shown embodiment, the annular edge 19 does not contact bottom wall 3, i.e. lateral walls 22 are shorter than lateral wall 9. In this case, in order to hold the cup-shaped collar 18 in position, each lateral wall 22 is glued to the inner surface of a respective lateral wall 9.

Figure 5:
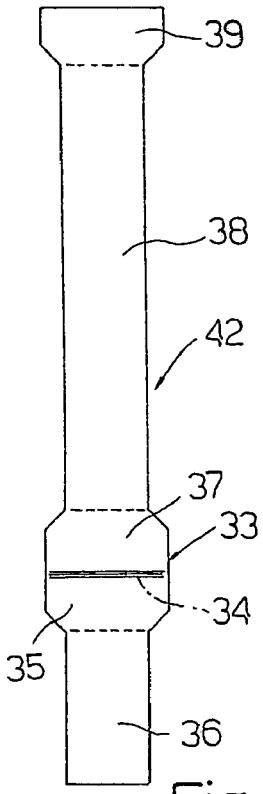
FIGS. 4, 5, 6 and 7 show plan views of respective elements of the FIG. 1 packet.
Figure 4:
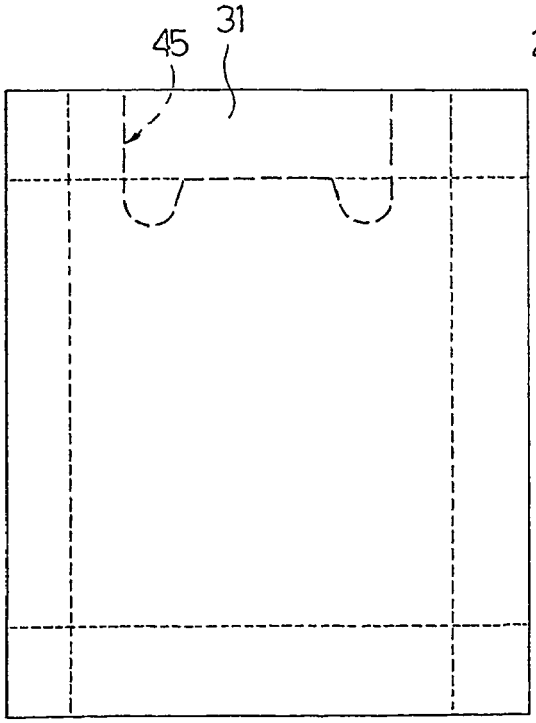

Packet A as described above is formed by folding and assembling together four blanks 41-44. Blank 41 (FIG. 4) is defined by a flat sheet of foil having, as of the top edge, a tear line 45 reproducing the outline of removable panel 31; and blank 42 (FIG. 5) provides for forming extracting device 40.

Blank 43 (FIG. 6) provides for forming cup-shaped collar 18, and comprises two substantially rectangular panels 46 and 47 connected by a substantially square intermediate panel 20' with beveled corners, which corresponds to end wall 20 and is provided with tab 28 connected to a longitudinal side of intermediate panel 20' along a longitudinal crease line 48. Panels 46 and 47 are connected to opposite transverse sides of intermediate panel 20' along respective transverse crease lines 49, and have longitudinal crease lines 50 defining, on panels 46 and 47, a number of rectangular panels indicated using the same numbers, with superscripts, as for the corresponding walls of cup-shaped collar 18. When a wall of collar 18 is formed by superimposing two normally glued panels of blank 43, the two panels are indicated using the same number as the relative wall, with a single superscript for the outside panel, and a double superscript for the inside panel.

Panel 46 is defined by three panels 22', the intermediate panel 22' of which is connected to end wall 20 along relative crease line 49; and by four panels 23', two of which are inner panels 23' located between panels 22', and two of which are outer panels 23' located outwards of panels 22'. Panel 47 is defined by a panel 22' connected to end wall 20 along relative crease line 49; and by two panels 23", which are superimposed on outer panels 23' to form the two longitudinal strips 23 of cup-shaped collar 18 adjacent to lateral wall 8. Straight slit 26 extends along intermediate panel 20', and the two slits 25 are formed one on intermediate panel 22' of panel 46, and the other on panel 22' of panel 47.

Figure 6:
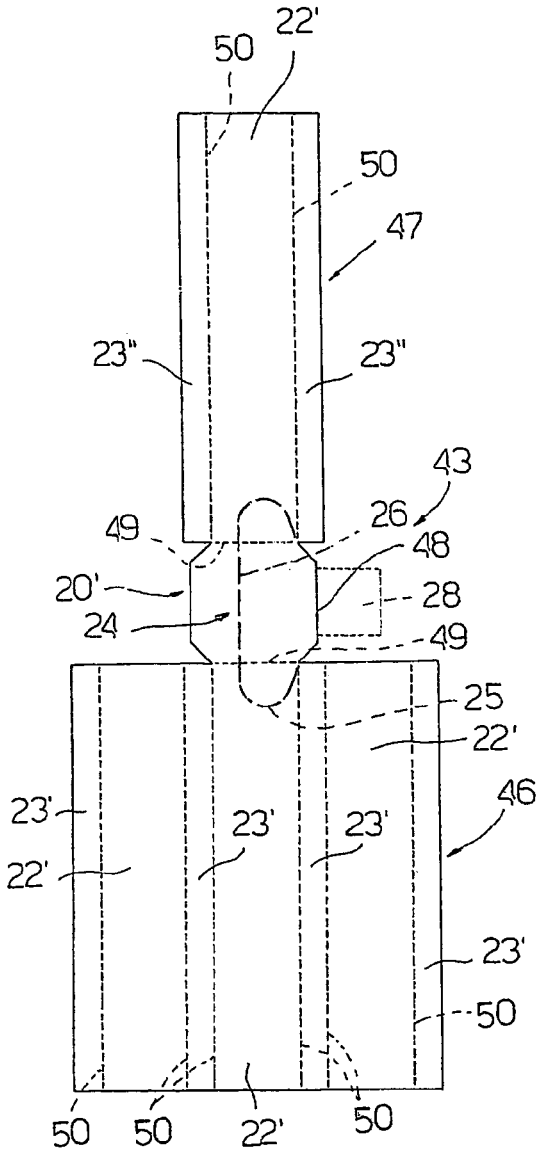
Figure 6A:
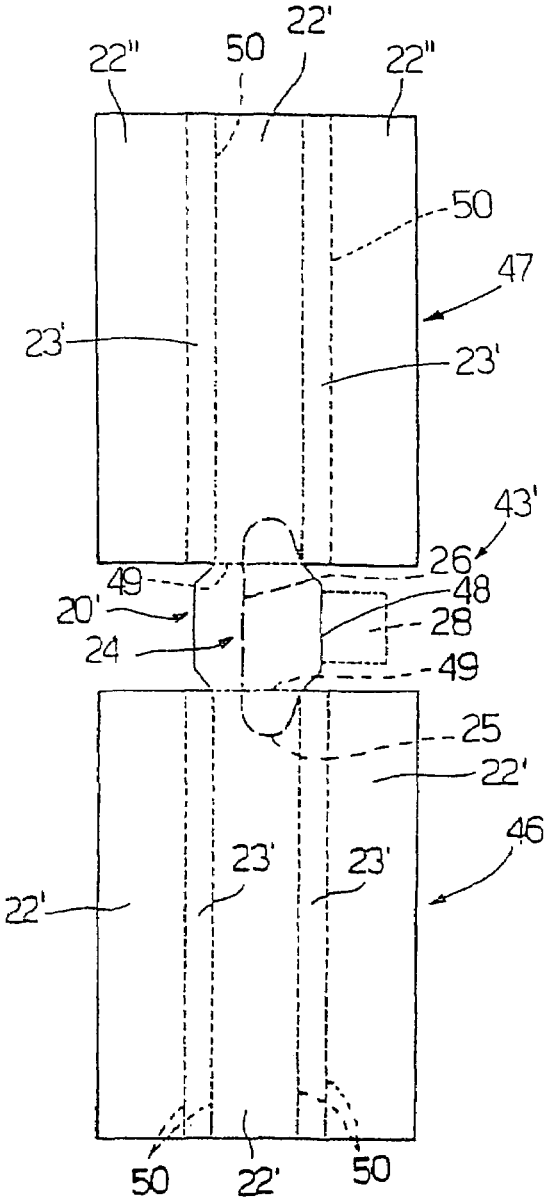
FIGS. 6*a* and 6*b* show alternative embodiments of the element of FIG. 6.

According to a further embodiment shown in FIG. 6*a* blank 43 can be replaced by a substantially identical blank 43'. The components of blank 43' are indicated, where possible, using the same reference numbers as for the corresponding parts of blank 43.

Blank 43' differs from blank 43 by having a panel 46, which does not comprise the two outer panels 23', and a panel 47 substantially specularly identical to panel 46, i.e. comprising an intermediate panel 22' and two outer panels 22" substantially identical to panels 22' of panel 46.

In order to obtain collar 18, two panels 22' of panel 46 are glued, each, to a respective outer surface of a relative panel 22".

Figure 6B:
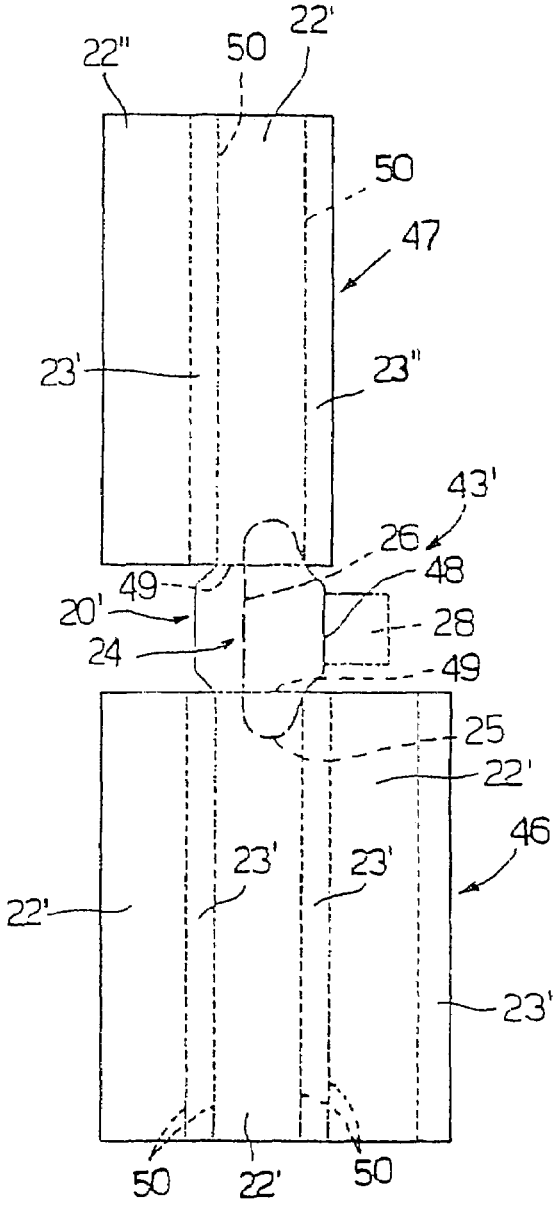

According to a further embodiment shown in FIG. 6*b*, panel 47 comprises just one outer panel 22", which, in order to obtain collar 18 is glued to a respective inner surface of a relative panel 22' of panel 46. In this case, panel 46 comprises one of the two outer panel 23', on which outer panel 23" of panel 47 is superimposed to form one longitudinal strip 23.

Blank 44 (FIG. 7) provides for forming case 1, and comprises two specularly identical, substantially rectangular panels 51 and 52 aligned with each other and connected by an intermediate panel 3' corresponding to bottom wall 3; and a further two panels 4' and 4", which are superimposed and glued to each other to form wall 4. A transverse side of panel 4' is connected along a transverse crease line 53 to the end of panel 51 opposite the end connected to intermediate panel 3'; and a transverse side of panel 4" is connected along a transverse crease line 54 to the end of panel 52 opposite the end connected to intermediate panel 3'. Panels 51 and 52 are connected to opposite transverse sides of intermediate panel 3' along respective transverse crease lines 55, and have longitudinal crease lines 56 defining, on panels 51 and 52, a number of rectangular panels also indicated using the same numbers, with superscripts, as for the corresponding walls of case 1. In this case, too, when a wall of case 1 is formed by superimposing two glued panels of blank 44, the two panels are indicated using the same number as the relative wall, with a single superscript for the outside panel, and a double superscript for the inside panel.

Panel 51 is defined by three side by side panels: an intermediate panel 9'; and two outer panels 7' and 8' connected to intermediate panel 9' by respective panels 10'. Panels 7', 8' and 9' are substantially identical as regards form and dimensions. Intermediate panel 9' is connected at opposite longitudinal ends to panel 3' along respective transverse crease line 55, and to panel 4' along crease line 53; an inclined slit 15 is formed across intermediate panel 9', from the end of crease line 53 facing panel 8'; part of hinge 13 is formed across panel 7'; and a slit 16 is formed across the panel 10' between panels 7' and 9'.

Panel 52 is defined by three side by side panels: an intermediate panel 9'; and two outer panels 7" and 8" connected to intermediate panel 9' by respective panels 10'. Panels 7", 8" and 9' are substantially identical as regards form and dimensions. Intermediate panel 9' of panel 52 is connected at opposite longitudinal ends to panel 3' along respective transverse crease line 55, and to panel 4" along crease line 54; an inclined slit 15 is formed across intermediate panel 9', from the end of crease line 54 facing panel 8"; part of hinge 13 is formed across panel 7"; and a slit 16 is formed across the panel 10' between panels 7" and 9'.

Two longitudinal tabs 57 extend from panel 51, are located on opposite sides of intermediate panel 3', project longitudinally from panel 7' and panel 8' respectively, and are folded squarely and glued to the inner surface of intermediate panel 3'. Similarly, panels 7' and 8' are glued to the outer surface of panel 7" and panel 8" respectively, to define lateral walls 7 and 8 of case 1; and, as stated, panels 4' and 4" are folded squarely, and panel 4' glued to the outer surface of panel 4" to define top wall 4 of case 1.

Panel 51 also comprises a longitudinal appendix 58, which has a number of transverse crease lines 59, extends from the end of panel 7' opposite the end supporting longitudinal tab 57, is folded squarely inwards of panel 4', and is glued at the free end to the end of the panel 22' contacting wall 7 of case 1 of packet A, to define toggle strap 32.

Figure 7:
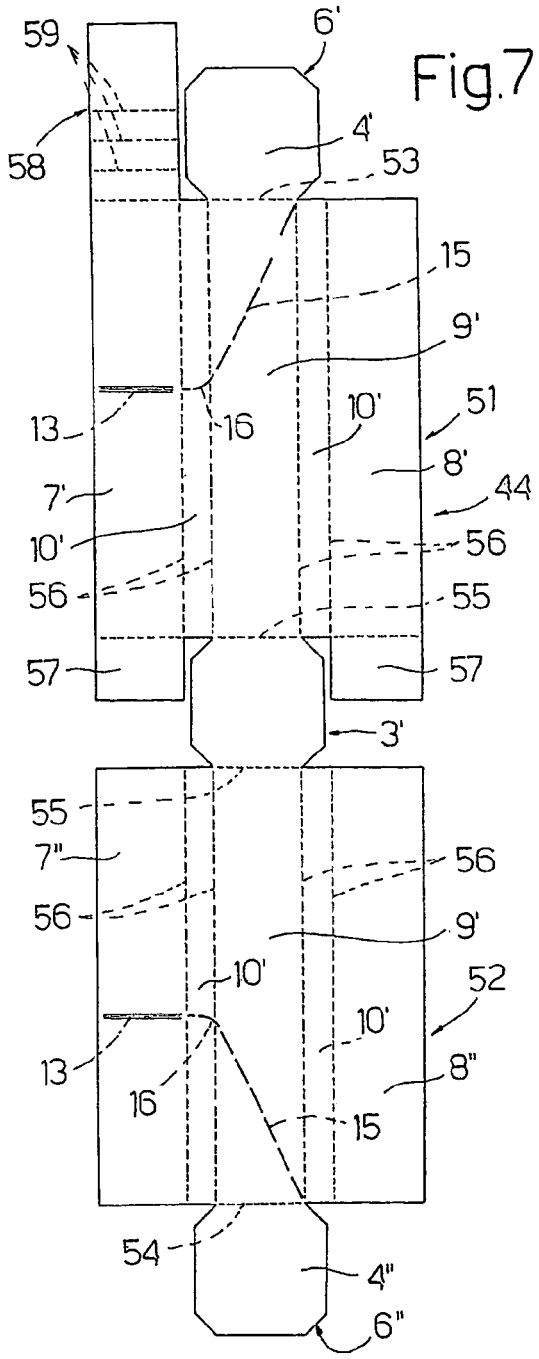

According to the embodiment shown in FIGS. 2, 3 and 7 appendix 58 has three crease lines 59. Nevertheless it should be appreciated that the crease lines 59 can more or less than three, e.g. two.

It should be pointed out that during the opening and the closing of lid 11 the snap actions of panels of appendix 58 defined by crease lines 59 contrast the movement of lid 11 itself.

In a variation not shown, as opposed to projecting longitudinally from panel 7' of blank 44, appendix 58 is located to the side of intermediate panel 20' of blank 43, and projects axially from the panel 22' of panel 46 of blank 43 on the left in FIG. 6.

FIGS. 8 to 11 show a packet B substantially similar to packet A, and the component parts of which are indicated, where possible, using the same reference numbers as for the corresponding parts of packet A.

Packet B differs from packet A mainly by having a substantially rectangular section, rounded corners 60 as opposed to flat bevels 6, and rounded longitudinal strips 61 and 62 as opposed to flat longitudinal strips 10 and 23.

Packet B also differs from packet A by having an opening 63 of the same size as opening 17 but extending over only a lateral portion 4*a* of top wall 4. In other words, as opposed to incorporating the whole of top wall 4, as in packet A, lid 11 of packet B only incorporates portion 4*a* of top wall 4, the rest of which is defined by a fixed portion 4*b*. As a result, in addition to inclined slits 15 across relative lateral walls 9, and slits 16 across relative rounded strips 61, tear line 14 also comprises a slit 64 across an intermediate portion of top wall 4 and connecting the top ends of inclined slits 15.

Figure 11:
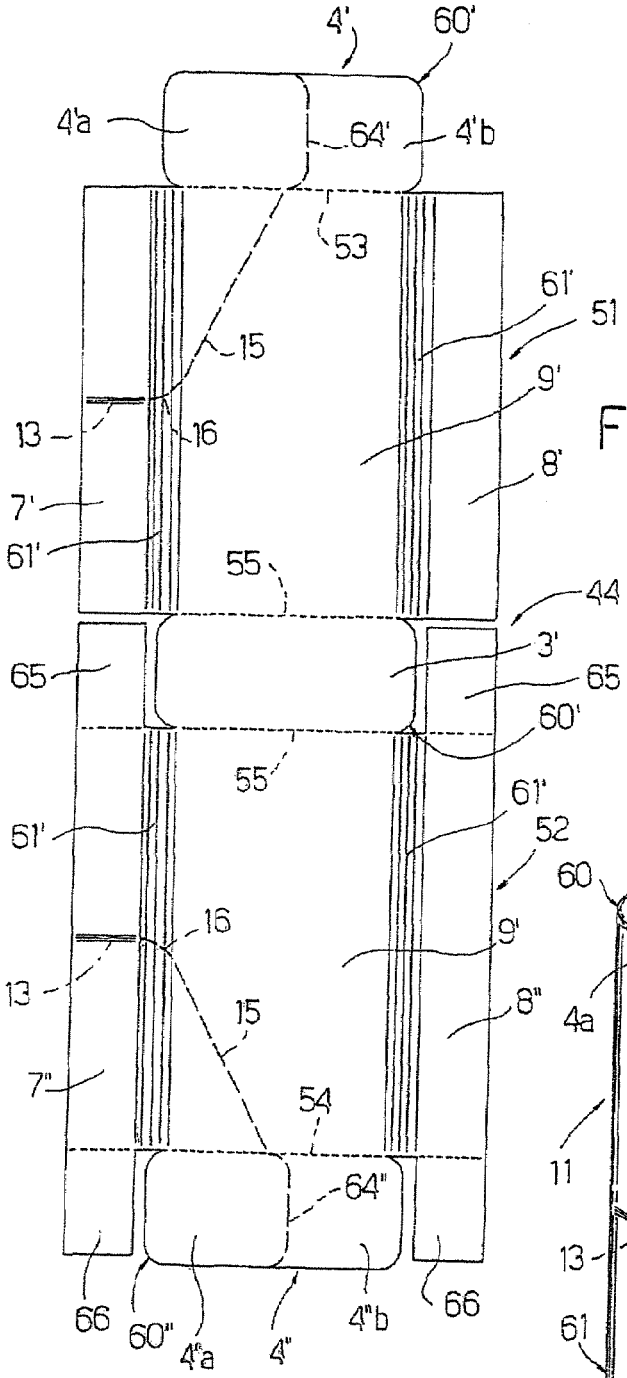
Figure 8:
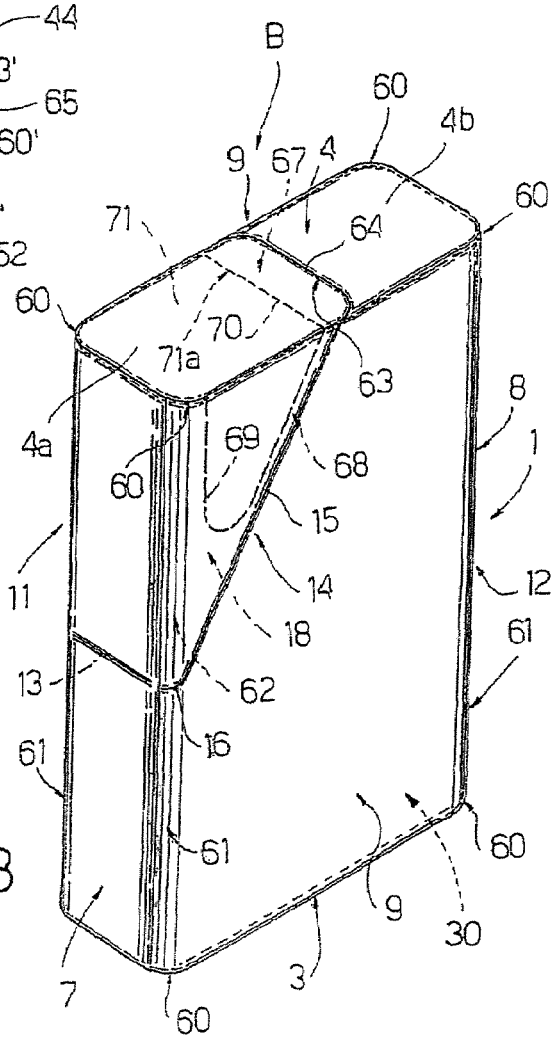
FIG. 8 shows a view in perspective of a second preferred embodiment of the packet according to the present invention in the closed position.

As shown in FIG. 11, in blank 44 of packet B, panels 10' of blank 44 of packet A are replaced by longitudinally creased panels 61' for forming rounded strips 61, and slit 64 is obtained by means of two pre-cut lines or slits 64' and 64" formed along end panels 4' and 4". Given the larger cross section of packet B as compared with packet A, walls 3 and 4 of packet B are preferably secured more firmly to the rest of case 1. For which purpose, in blank 44 of packet B, the longitudinal tabs 57 of panel 51 of blank 44 of packet A are replaced by two pairs of tabs 65 and 66. Tabs 65 extend from panel 52, on opposite sides of intermediate panel 3', project longitudinally from panel 7" and panel 8" respectively, and are folded squarely and glued to the inner surface of intermediate panel 3'; while tabs 66 extend from panel 52, on opposite sides of end panel 4", project longitudinally from panel 7" and panel 8" respectively, and are folded squarely and glued to the inner surface of end panel 4".

The same alteration may obviously also be made, if necessary, to blank 44 of packet A, in which, as in packet B, flat bevels 6 may be replaced by rounded corners similar to rounded corners 60, and flat longitudinal strips 10 and 23 may be replaced by rounded strips similar to rounded strips 61 and 62.

In blank 43 of packet B, panels 23' and 23" of blank 43 of packet A are replaced by longitudinally creased panels 62' and 62" for forming rounded strips 62; and intermediate panel 20' of blank 43 of packet A is replaced by a substantially rectangular, round-cornered, intermediate panel 67 of the same shape and size as wall 4 of packet B, and along which is formed a tear line 68 comprising two U-shaped slits 69 formed on the central panels 22', and a straight slit 70 formed along intermediate panel 67 to define, on blank 43 and together with a free lateral edge of panel 67 located between the two U-shaped slits 69, a removable panel 71, which, when removed together with removable panel 31 of blank 41, defines a passage or opening 71*a* allowing access to cigarettes 2 when lid 11 is opened.

In packet B, appendix 58 defining the toggle strap 32 (not shown) limiting the opening travel of lid 11 forms part of panel 46 of blank 43, as in the variation (not shown) of blank 43 of packet A. In packet B too, appendix 58 may obviously form part of blank 44, as in packet A.

FIGS. 12 to 17 show a packet C substantially similar to packet B, and the component parts of which are indicated, where possible, using the same reference numbers as for the corresponding parts of packet B.

Like packet B, packet C has a substantially rectangular section, but with sharp longitudinal edges 72, and therefore no flat bevels 6 or flat longitudinal strips 10 and 23 as in packet A, and no rounded edges 60 or rounded longitudinal strips 61 and 62 as in packet B, so that blanks 44 and 43 of packet C have no panels 61.

However, by applying what has been stated relative to packets A and B, a person skilled in the art may obviously also form a packet C with beveled or rounded edges in place of sharp edges 72, and, similarly, on the basis of the following description, may alter packets A and B to feature sharp edges as in packet C.

Packet C therefore has a section similar to that of packet B, from which it differs by cup-shaped container 12 having an opening 73 extending over the whole of top wall 4, as in packet A.

More specifically, lid 11 of packet C is defined at the top by the whole of top wall 4, and is separated from the rest of case 1 by a tear line 14, a first portion of which extends along the join between top wall 4 and lateral wall 8, and a second portion of which is defined by two straight slits 15, each extending, in packet C, at a 45° angle across the whole width of relative lateral wall 9, between a corner of lateral wall 9 adjacent to top wall 4 and wall 8, and an intermediate point along the edge 72 of lateral wall 9 adjacent to lateral wall 7.

From opening 73 of cup-shaped container 12, there projects outwards the top end of collar 18, which, in this case too, is cup-shaped, is housed inside cup-shaped container 12 with its concavity facing bottom wall 3, and with an end wall 74 just inwards of top wall 4. End wall 74 is also substantially rectangular with sharp corners, and closes a tubular body 21 defined by four lateral walls 22 connected to one another by sharp edges 75.

Figure 12:
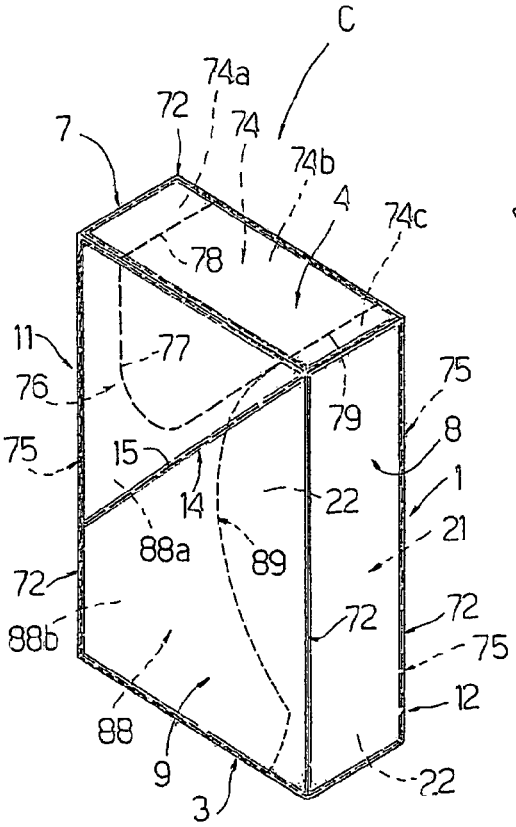
FIG. 12 shows a view in perspective of a third preferred embodiment of the packet according to the present invention in the closed position.

As shown in FIG. 12, a tear line 76 is formed across the end of cup-shaped collar 18 facing opening 73, and has two portions defined by two U-shaped slits 77, each located with its concavity facing upwards on the projecting portion of a respective lateral wall 22 contacting the inner surface of a respective lateral wall 9 as of the top end of lateral wall 22. Tear line 76 also comprises two straight slits 78 and 79 formed across end wall 74, joining the corresponding ends of the two slits 77, and dividing end wall 74 into three portions 74*a*, 74*b* and 74*c*, of which portion 74*b* extends between the two slits 78 and 79.

Figure 13:
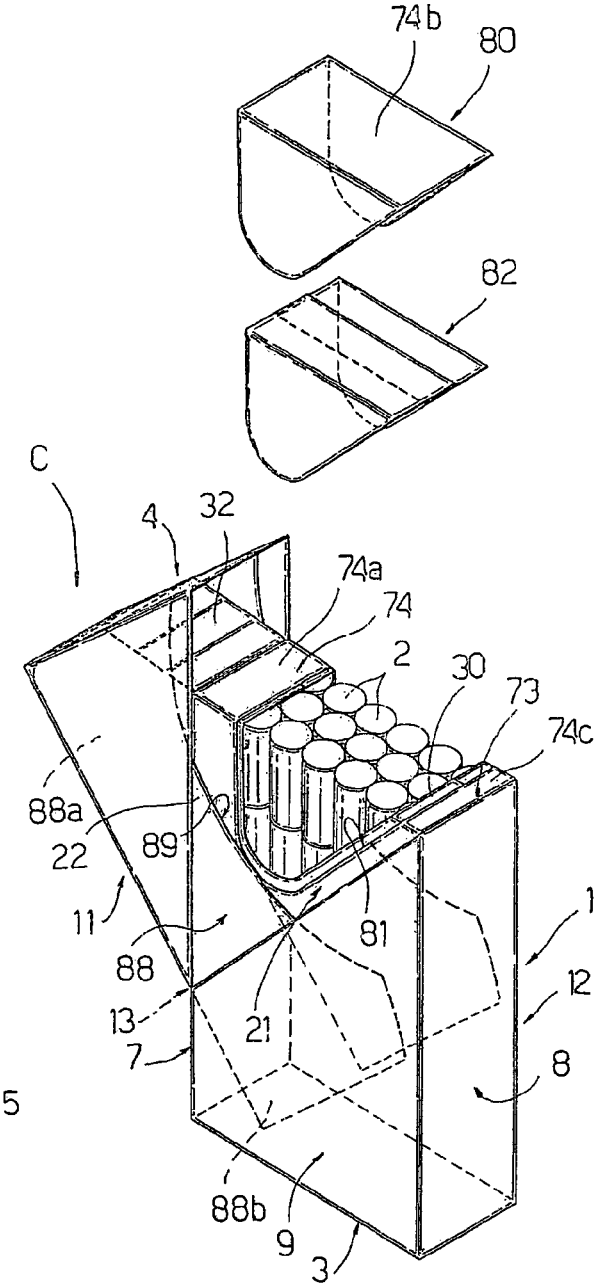
FIG. 13 shows a partly exploded view in perspective of the FIG. 12 packet in the open position.
Figure 14:
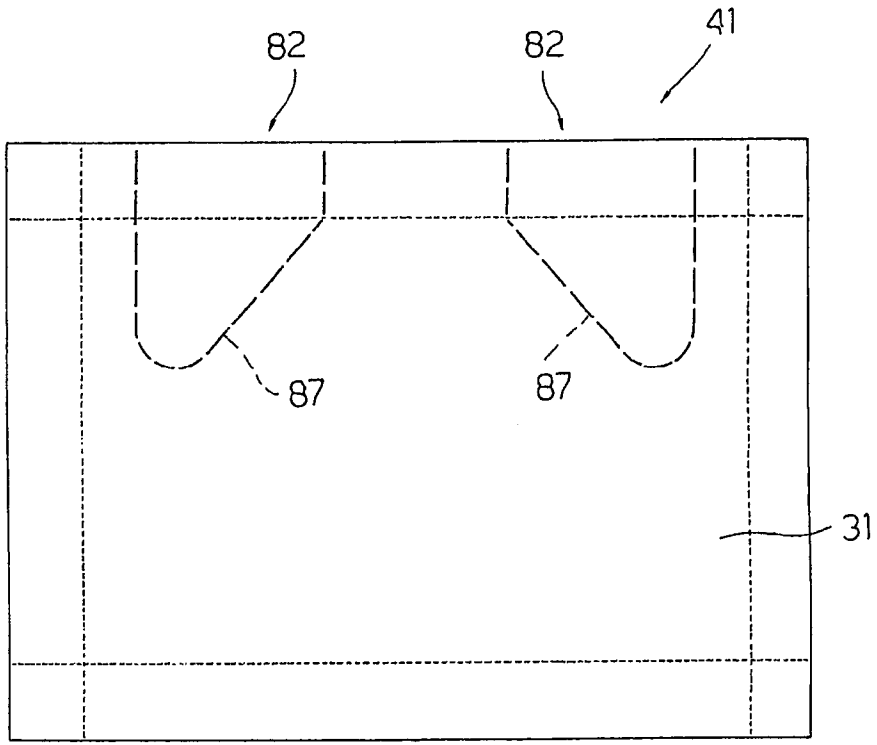
FIGS. 14, 15, 16 and 17 show plan views of respective elements of the FIG. 12 packet.
Figure 15:
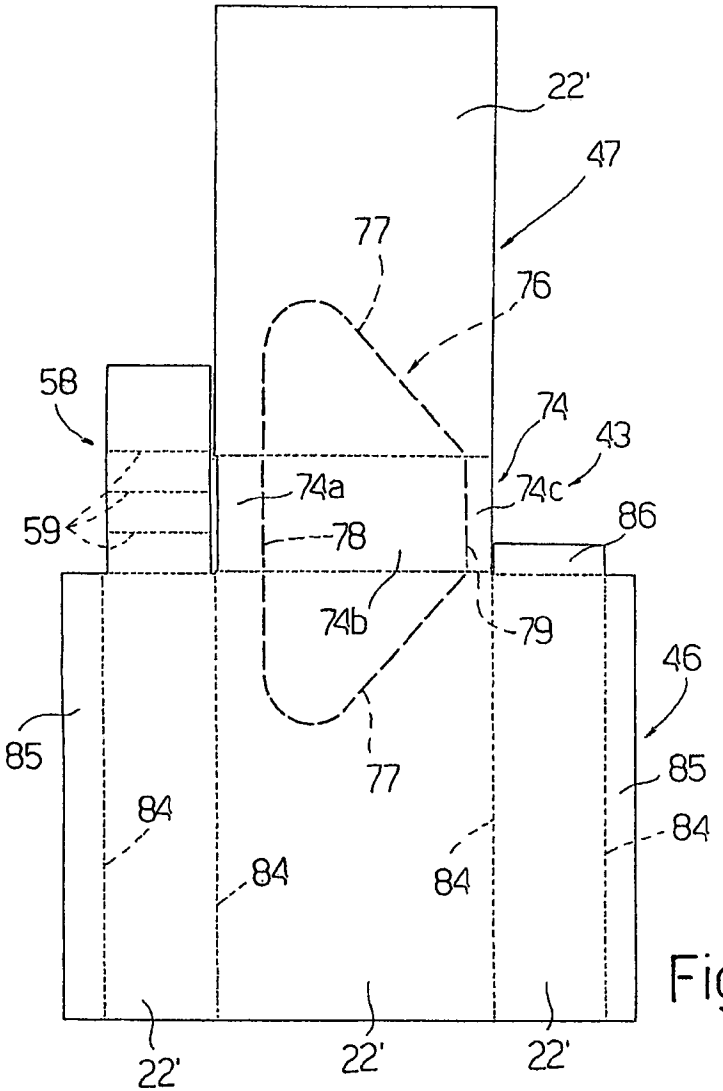

As shown in FIG. 13, tear line 76 defines a panel 80, which can be removed by the user to define, across cup-shaped collar 18, a passage or opening 81 revealing the inner foil wrapping 30 also having a removable panel 82, as in packets A and B.

As shown more clearly in FIG. 13, an edge of portion 74*a* of end wall 74 is connected to a central portion of the inner surface of top wall 4 by toggle strap 32.

Figure 16:
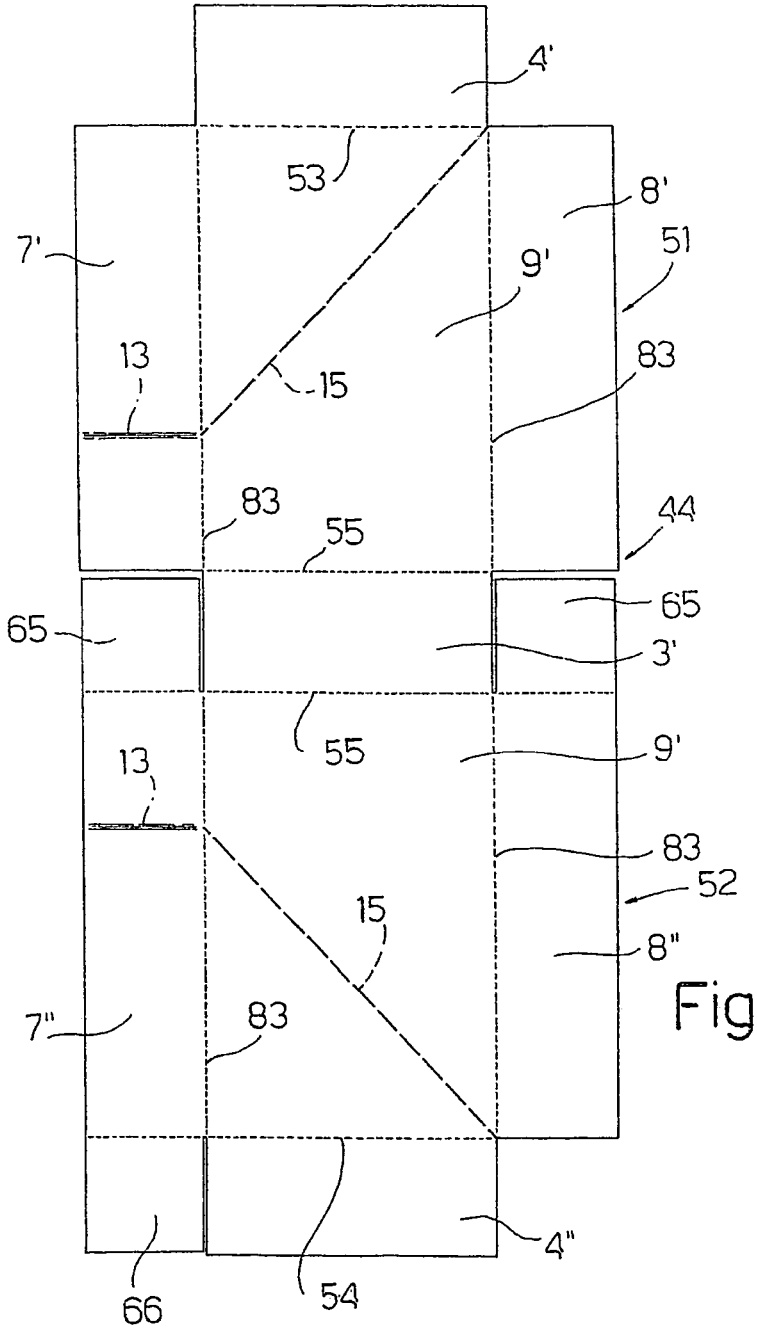

As shown in FIG. 16, in blank 44 of packet C, sharp edges 72 are defined by straightforward crease lines 83, panels 7" and 8" have respective tabs 65, and only panel 7" has a tab 66.

In blank 43 of packet C, edges 75 are defined by straightforward crease lines 84; panel 47 is defined by one panel 22'; and panel 46 is defined by three side by side panels 22', and by two lateral tabs 85 which are folded squarely and glued beneath the single panel 22' of panel 47. At the end facing end wall 74 interposed between panels 46 and 47 and connected to panels 46 and 47 by transverse crease lines, one of the two lateral panels 22' of panel 46 has appendix 58—which may obviously form part of blank 44, as in packet A—and the other has a longitudinal tab 86 which is folded squarely and glued beneath portion 74*c* of end wall 74.

Figure 17:
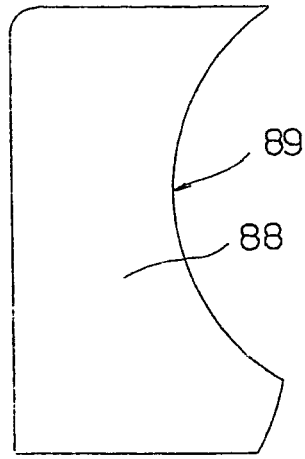

As shown more clearly in FIGS. 12 and 13, to guide lid 11 better as it rotates about hinge 13, packet C has two guide plates 88, each of which, as shown in FIG. 17, is substantially rectangular, is more or less the same shape as but no larger than a wall 9, and is defined laterally by a curved edge 89 with its concavity facing outwards. Each guide plate 88 is inserted beneath a respective wall 9; a portion 88*a*, located beneath lid 11, is glued to the part of respective wall 9 forming part of lid 11; and the rest, indicated 88*b*, is left free to slide between respective wall 9 and collar 18.

According to further embodiments, which are not shown in the drawings, packet A and B comprise in place of bevels 6 and, respectively, rounded edges 8 sharp edges. Moreover, packet A and B comprise one or more lateral walls 7, 8 and 9 having, each, a respective central flat portion and two lateral bands curved with concavity facing inwards to connect the relative central portion to the relative sharp edge, as substantially described in patent application WO 00/43289.

Analogously, packet C may comprise one or more lateral walls 7, 8 and 9 having, each, a respective central flat portion and two lateral bands curved with concavity facing inwards to connect the relative central portion to the relative sharp edge 72.

According to further embodiments packets A, B and C have substantially the shape of a packet as described in patent application WO 02/32786.

The invention claimed is:

1. A lateral-opening, rigid, hinged-lid packet, the packet comprising a case having four lateral walls and a top wall and in turn comprising a cup-shaped container with a top opening, a collar projecting partly from said cup-shaped container through said top opening, and a lid hinged to said cup-shaped container along a lateral hinge and movable about said hinge to and from a closed position closing said top opening; said lid incorporating at least part of said top wall; said case being formed from a blank having two substantially identical first panels which are superimposed to form said top wall and a number of second panels, which form said lateral walls and are substantially identical to each other as regards form and dimensions; three of said second panels being arranged in a substantially straight row so as to be side by side; said collar being a tubular collar coaxial with said cup-shaped container; said collar having a top closing wall adjacent to said top wall and having a passage, for the cigarettes, facing said lid.

2. The packet of claim 1, wherein said passage is closed by a removable panel.

3. The packet of claim 1, wherein said blank comprises a number of main panels arranged in a line so as to be side by side; three of said main panels being substantially identical, and comprising said two first panels, and a further main panel defining a bottom wall of said case.

4. The packet of claim 3, wherein said two first panels are located at opposite ends of said blank; said further main panel being an intermediate panel of said blank.

5. The packet of claim 1, wherein said case and said tubular collar have beveled longitudinal edges.

6. The packet of claim 1, wherein said case and said tubular collar have rounded longitudinal edges.

7. The packet of claim 1, wherein said case and said tubular collar have sharp longitudinal edges.

8. The packet of claim 1, wherein said passage extends over a lateral portion of said top closing wall of said collar.

9. The packet of claim 8, wherein said passage extends over a lateral portion of said top closing wall adjacent to said lid.

10. The packet of claim 8, wherein said top closing wall comprises a fixed portion; said passage extending over a lateral portion of said top closing wall located on the opposite side to said fixed portion with respect to said lid.

11. The packet of claim 2, wherein said removable panel comprises a lateral pull tab.

12. The packet of claim 8, wherein said passage extends over a central portion of said top closing wall.

13. The packet of claim 1, further comprising a foil inner wrapping; said inner wrapping comprising a further removable panel located at said passage.

14. The packet of claim 13, further comprising an extracting device housed partly inside said collar and between the collar and said inner wrapping; part of said extracting device being defined by a pull tab projecting from said collar through said passage.

15. The packet of claim 1, further comprising a toggle strap interposed between said lid and said collar to limit the angular travel of said lid about said hinge.

16. The packet of claim 15, wherein said toggle strap forms an integral part of said collar.

17. The packet of claim 15, wherein said toggle strap forms an integral part of said blank.

18. The packet of claim 1, further comprising two lateral guide plates, each comprising a first portion integral with an inner lateral surface of said lid, and a second portion engaged in sliding manner between said case and said collar.

19. A lateral-opening, rigid, hinged-lid packet, the packet comprising a case having a top wall and in turn comprising a cup-shaped container with a top opening, a collar projecting partly from said cup-shaped container through said top opening, and a lid hinged to said cup-shaped container along a lateral hinge and movable about said hinge to and from a closed position closing said top opening; said lid incorporating at least part of said top wall; the collar being a tubular collar coaxial with said cup-shaped container; said tubular collar having a top closing wall adjacent to said top wall and having a passage, for said cigarettes, facing said lid; said case being formed from a blank having two substantially identical panels which are superimposed to form said top wall.

20. The packet of claim 19, wherein said passage is closed by a removable panel.

21. The packet of claim 19, wherein said blank comprises a number of main panels arranged in a line so as to be side by side; three of said main panels being substantially identical, and comprising said two panels, and a further main panel defining a bottom wall of said case.

22. The packet of claim 21, wherein said two panels are located at opposite ends of said blank; said further main panel being an intermediate panel of said blank.

23. The packet of claim 19, wherein said case and said tubular collar have beveled longitudinal edges.

24. The packet of claim 19, wherein said case and said tubular collar have rounded longitudinal edges.

25. The packet of claim 19, wherein said case and said tubular collar have sharp longitudinal edges.

26. The packet of claim 19, wherein said passage extends over a lateral portion of said top closing wall of said collar.

27. The packet of claim 26, wherein said passage extends over a lateral portion of said top closing wall adjacent to said lid.

28. The packet of claim 26, wherein said top closing wall comprises a fixed portion; said passage extending over a lateral portion of said top closing wall located on the opposite side to said fixed portion with respect to said lid.

29. The packet of claim 20, wherein said removable panel comprises a lateral pull tab.

30. The packet of claim 26, wherein said passage extends over a central portion of said top closing wall.

31. The packet of claim 19, further comprising a foil inner wrapping; said inner wrapping comprising a further removable panel located at said passage.

32. The packet of claim 31, further comprising an extracting device housed partly inside said collar and between the collar and said inner wrapping; part of said extracting device being defined by a pull tab projecting from said collar through said passage.

33. The packet of claim 19, further comprising a toggle strap interposed between said lid and said collar to limit the angular travel of said lid about said hinge.

34. The packet of claim 33, wherein said toggle strap forms an integral part of said collar.

35. The packet of claim 33, wherein said toggle strap forms an integral part of said blank.

36. The packet of claim 19, further comprising two lateral guide plates, each comprising a first portion integral with an inner lateral surface of said lid, and a second portion engaged in sliding manner between said case and said collar.

37. The packet of claim 19, wherein said tubular collar comprises at least one longitudinal lateral wall formed from the superimposition of at least two panels.

38. The packet of claim 33, wherein the toggle strap comprises a longitudinal appendix having a number of crease lines.

39. A lateral-opening, rigid, hinged-lid packet, the packet comprising a case having four lateral walls, a bottom and a top wall and in turn comprising a cup-shaped container with a top opening, a collar projecting partly from said cup-shaped container through said top opening, and a lid hinged to said cup-shaped container along a lateral hinge and movable about said hinge to and from a closed position closing said top opening; said lid incorporating at least part of said top wall; the bottom wall having two first edges, which extend parallel to each other in a first direction, and two respective second edges, which extend parallel to each other in a second direction; the top wall having two third edges, which extend parallel to each other in said first direction, and two fourth edges, which extend parallel to each other in the second direction; the first, the second, the third and the fourth edges having substantially the same length; the first and the second direction being substantially perpendicular with respect to each other; said collar being a tubular collar coaxial with said cup-shaped container; said collar having a top closing wall adjacent to said top wall and having a passage, for the cigarettes, facing said lid.

40. A lateral-opening, rigid, hinged-lid packet, the packet comprising a case having four lateral walls, a bottom and a top wall and in turn comprising a cup-shaped container with a top opening, a collar projecting partly from said cup-shaped container through said top opening, and a lid hinged to said cup-shaped container along a lateral hinge and movable about said hinge to and from a closed position closing said top opening; said lid incorporating at least part of said top wall; the bottom having two respective first edges, which are parallel to each other, and two second edges, which are parallel to each other; the top wall having two third edges, which are parallel to each other and to the first edges, and two fourth edges, which are parallel to each other and to the second edges; the first, the second, the third and the fourth edges having substantially the same length; the first edges being directed substantially perpendicularly with respect to the second edges; the third edges being directed substantially perpendicularly with respect to the fourth edges; said collar being a tubular collar coaxial with said cup-shaped container; said collar having a top closing wall adjacent to said top wall and having a passage, for the cigarettes, facing said lid.

41. The packet of claim 39, wherein the bottom and the top wall are substantially squared-shaped.

42. The packet of claim 39, wherein said case being formed from a blank having two substantially identical first panels which are superimposed to form said top wall.

43. The packet of claim 42, wherein the blank comprises and a number of second panels, which form said lateral walls and are substantially identical to each other as regards form and dimensions; three of said second panels being arranged in a substantially straight row so as to be side by side.

44. A lateral-opening, rigid, hinged-lid packet, the packet comprising a case having four lateral walls, a bottom wall and a top wall and in turn comprising a cup shaped container with a top opening, a collar projecting partly from said cup-shaped container through said top opening, and a lid hinged to said cup-shaped container along a lateral hinge and movable about said hinge to and from a closed position closing said top opening; said lid incorporating at least part of said top wall; the packet being characterized in that the bottom wall and the top wall are substantially squared shaped; said case being formed by folding a blank having two substantially rectangular panels; an intermediate panel, which connects the two substantially rectangular panels and forms the bottom wall; and substantially identical first panels, each of which is connected to one of the two substantially rectangular panels and which are superimposed to form said top wall; each substantially rectangular panel comprises at least three second panels, which are substantially identical to each other as regards form and dimensions, are arranged in a line so as to be side by side and are designed to form said lateral walls; two lateral walls of the case are formed, each, by the overlapping of two respective second panels.

* * * * *